United States Patent [19]

Tsutsumi et al.

[11] Patent Number: 4,488,525

[45] Date of Patent: Dec. 18, 1984

[54] ENGINE SPEED CONTROL DEVICE FOR INTERNAL COMBUSTION ENGINE

[75] Inventors: Kazumichi Tsutsumi, Hyogo; Tadakazu Ueda, Hiroshima, both of Japan

[73] Assignees: Mitsubishi Denki Kabushiki Kaisha; Mazda Motor Corporation, both of Japan

[21] Appl. No.: 423,333

[22] Filed: Sep. 24, 1982

[30] Foreign Application Priority Data

Sep. 25, 1981 [JP] Japan ..... 56-152783

[51] Int. Cl.[3] ..... F02D 31/00

[52] U.S. Cl. ..... 123/352

[58] Field of Search ..... 123/352, 357, 359, 361, 123/360; 180/179, 176

[56] References Cited

U.S. PATENT DOCUMENTS

| | | | |
|---|---|---|---|
| 3,804,193 | 4/1974 | Ikuta | 123/352 |
| 4,188,926 | 2/1980 | Fleischer | 123/352 |
| 4,267,491 | 5/1981 | Collonia | 123/352 |
| 4,301,883 | 11/1981 | Collonia | 123/352 |

*Primary Examiner*—Andrew M. Dolinar

*Attorney, Agent, or Firm*—Sughrue, Mion, Zinn, Macpeak & Seas

[57] ABSTRACT

An engine speed control apparatus includes speed and throttle sensors and an arithmetic unit which derives throttle values according to the difference between the desired speed and the actual speed. If part of the throttle operation loop becomes inoperative such that the desired throttle value differs from the actual throttle value by a given amount for a given time, a judgement circuit suspends the operation of the arithmetic unit until the throttle operation loop operates normally.

6 Claims, 4 Drawing Figures

ENGINE SPEED CONTROL DEVICE FOR INTERNAL COMBUSTION ENGINE

BACKGROUND OF THE INVENTION

This invention relates to an engine speed control device for an internal combustion engine.

FIG. 1 is a block diagram showing an example of a conventional engine speed control device of this type. In FIG. 1, there are arranged an internal combustion engine 100, a throttle valve 101 for said internal combustion engine, an actuator 200 for operating the throttle valve 101, and an engine speed sensor 300 for detecting the engine speed of the internal combustion engine 100. An arithmetic unit 400 integrates the deviation of engine speed c between the actual engine speed a of the internal combustion engine as detected by the engine speed sensor 300 and a predetermined desired engine speed b. An opening degree sensor 500 detects the opening of the throttle valve 101, and a driver 600 operates the throttle valve 101 through the actuator 200 according to the deviation of an opening f between a desired opening e, or the output of the arithmetic unit 400, and an actual opening d as detected by the opening sensor 500.

In the construction described above, if the actual engine speed a drops due to any cause below the desired engine speed b as shown in the timing chart of FIG. 2, the arithmetic unit 400 integrates the resultant deviation of the engine speed c, and the desired opening e is increased.

As a result, the deviation of the opening f increases, and the driver 600 opens the throttle valve 101 through the actuator 200, so that the actual engine speed a increases until it reaches the engine speed b. Contrarily, if the actual engine speed a rises above the desired engine speed b, the actual engine speed a is controlled to equal the desired engine apeed b through actions similar to that described above.

In the conventional device mentioned above, if the actuator 200 is made unable to operate due to any cause so that the engine speed can not be controlled, the deviation of engine speed c continues to occur, and as a result, the desired opening e continues to change until it reaches a saturated condition. If the condition in which the actuator is disabled occurs when the actual engine speed a is lower than the desired engine speed b, the desired opening e reaches the maximum value that it can take. Then, if the actuator 200 returns to the normal operating condition from the disabled condition, the throttle valve will repidly be opened to a large value since the desired opening f has risen to a very large value, with obvious hazardous consequenses such as blow up of the engine.

Contrarily, if the actual engine speed a was higher than the desired engine speed b, the internal combustion engine 100 is stopped through the same process mentioned above.

Accordingly, in the conventional device, there is a problem that the internal combustion engine 100 may be destroyed or stopped if the actuator 200 momentarily becomes unable to operate.

SUMMARY OF THE INVENTION

The present invention has been made to solve the problem pertaining to the conventional device described above; and an object of this invention is to provide an engine speed control device for an internal combustion engine which can prevent the occurrence of engine destruction or engine stop in the event that a part of the control system momentarily becomes unable to operate.

DETAILED DESCRIPTION OF THE PREFERRED EMBODIMENTS

Figure 1:
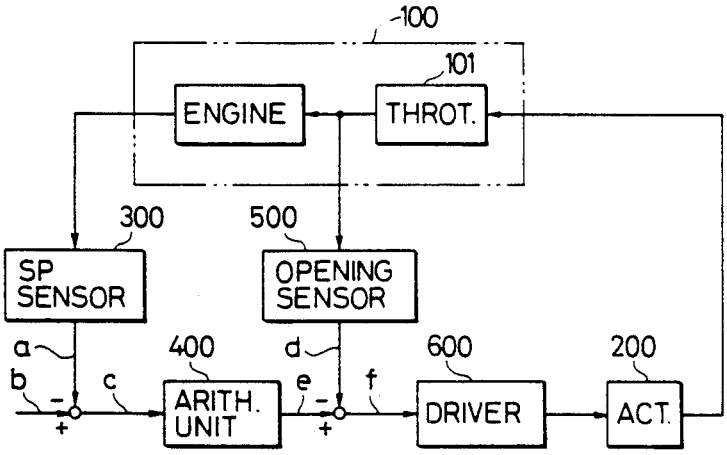
FIG. 1 PRIOR ART
FIG. 1 is a block diagram showing the constitution of a conventional engine speed control device for an internal combustion engine.
Figure 2:
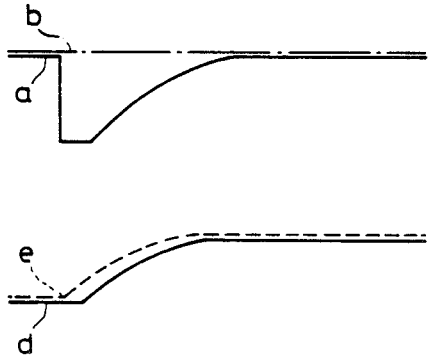
FIG. 2 is a timing chart showing the operation of the engine speed control device shown in FIG. 1.
Figure 3:
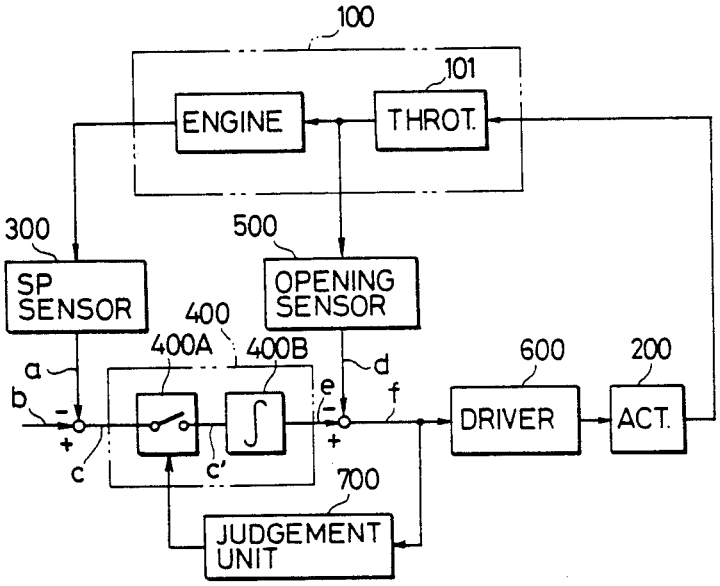
FIG. 3 is a block diagram showing the constitution of an embodiment of an engine speed control device according to this invention.

An embodiment of the engine speed control device according to this invention will now be described with reference to the accompanying drawings. FIG. 3 is a block diagram showing the constitution of the embodiment. In FIGS. 1 and 3, numerals from 100 to 300 and 500 to 600 denote the same or equivalent parts, respectively.

In FIG. 3, a judgement unit 700 governs the operation and stoppage of the arithmetic unit 400 according to the condition of the deviation of the opening f. If the deviation f continues to take a value equal to or above a predetermined value for a predetermined period of time, the judgement unit 700 stops the operation of the arithmetic unit 400 to hold the output thereof, and, if the deviation f is equal to or below a predetermined value, it allows the arithmetic unit 400 to operate.

Figure 4:
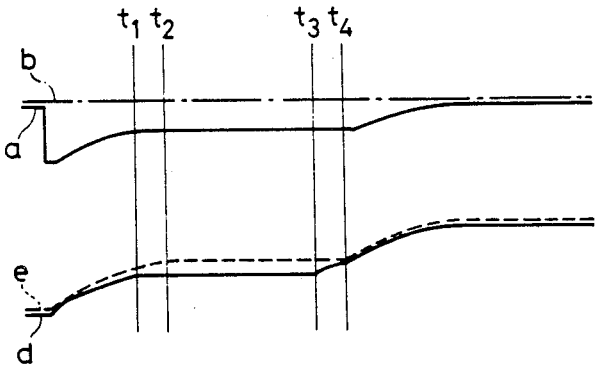
FIG. 4 is a timing chart showing the operation of the engine speed control device shown in FIG. 3.

More specifically, in FIG. 3, reference numerals 400A and 400B designate a control circuit and an integrator, respectivly. When the decision circuit 700 produces an output to stop the operation of the arithmetic circuit 400, the control circuit 400A produces an output $C'=0$ regardless of signal C, so that the output of the integrator 400B is maintained unchanged. On the other hand, when the decision circuit 700 produces no stop signal, the control circuit 400A operates to allow the signal C to pass therethrough and an integration operation on the signal C is thus carried out. The operation of the engine speed control device according to this invention having such construction will now be described with reference to the timing chart of FIG. 4. In FIG. 4, t1 denotes the point at which the actuator 200 becomes unable to operate: ta, the point at which the operation of the arithmetic unit 400 is stopped and its output is held; 53, the time when the actuator 200 returns to its normal operating condition; and t3 denotes the point when the arithmetic unit 400 returns to normal operation.

For example, if the actuator 200 is disabled under the condition such that the actual engine speed a is lower than the desired engine speed b, the desired opening e continues to rise as described in the conventional device. However, as a result, the deviation of the opening f continues to take a value equal to or above a predetermined value for a predetermined period of time, so that the operation of the arithmetic unit 400 is suspended by the action of the judgment unit 700, and its output is held. Then, if the actuator 200 returns to its normal operating condition, the throttle valve 101 is operated, the throttle opening d is controlled to the desired opening e, the deviation f becomes equal to or below the predetermined value, and the arithmetic unit 400 is allowed to resume its normal operation.

Although the above description was for the case where the actual engine speed a was lower than the desired engine speed b, the same actions described above are performed in the case where the actual engine speed a is higher than the desired speed b.

Thus, if the actuator 200 becomes unable to operate, the rise or drop of the desired opening e is maintained at a small value, and, when the actuator 200 returns to its normal operating condition, a rapid increase in engine speed or engine stop as occurred in the conventional device will not be caused.

Although the above description was for the case where the judgment unit 700 operated according to the opening f, the same effect may be obtained where the judgment unit 700 operates according to the output condition of the driver 600, which acts correspondingly directly to the deviation f.

As described above, with the engine speed control device according to this invention, the judgment unit rapidly stops the operation of the arithmetic unit to hold its output value, referring to the opening deviation or a value corresponding thereto, in the event that a part of the throttle opening control loop becomes unable to operate. Accordingly, the engine speed can be controlled in the internal combustion engine without the difficulties of the conventional devices.

What is claimed is:

1. An engine speed control device, comprising; an acutator for controlling a control valve of said engine, an opening sensor for detecting a degree of opening of said control valve, an arithmetic unit for producing an output value determined according to the deviation between an actual engine speed of said engine and a predetermined desired engine speed, means for controlling said control valve through said actuator according to the deviation between said output value of the arithmetic unit representing a desired opening degree of said control valve and an actual opening degree detected by said opening sensor, and decision means for suspending the operation of said arithmetic unit to hold said output value when said deviation of said opening degree is continuously maintained equal to or above a predetermined value for a predetermined period of time.

2. An engine speed control device as claimed in claim 1, wherein operation of said arithmetic unit is again initiated when said deviation of opening degree assumes a value equal to or below a predetermined value.

3. An engine speed control device as claimed in claims 1 or 2, wherein said control valve comprises a throttle valve of said engine.

4. An engine speed control device as claimed in claim 1, wherein said arithmetic unit comprises at least a control circuit and an arithmetic circuit, said control circuit being controlled by said decision circuit to vary an output thereof.

5. An engine speed control device as claimed in claim 4, said output of said control circuit being maintained at a zero value by said decision circuit until said opening degree deviation falls below a predetermined value.

6. An engine speed control device as claimed in claim 5, said arithmetic circuit comprising at least an integrator.

* * * * *